US011160706B1

(12) United States Patent
Keesaer et al.

(10) Patent No.: US 11,160,706 B1
(45) Date of Patent: Nov. 2, 2021

(54) PATIENT SUPPORT ARRANGEMENT

(71) Applicant: John Keesaer, Louisville, KY (US)

(72) Inventors: John Keesaer, Louisville, KY (US); Donald R Burns, Louisville, KY (US)

(73) Assignee: John Keesaer, Louisville, KY (US)

( * ) Notice: Subject to any disclaimer, the term of this patent is extended or adjusted under 35 U.S.C. 154(b) by 90 days.

(21) Appl. No.: 16/507,612

(22) Filed: Jul. 10, 2019

Related U.S. Application Data

(63) Continuation-in-part of application No. 16/378,279, filed on Apr. 8, 2019, now abandoned.

(60) Provisional application No. 62/654,431, filed on Apr. 8, 2018.

(51) Int. Cl.
*A61G 7/057* (2006.01)
*A61G 7/002* (2006.01)

(52) U.S. Cl.
CPC ..... *A61G 7/05761* (2013.01); *A61G 7/05776* (2013.01); *A61G 7/002* (2013.01)

(58) Field of Classification Search
CPC ..... A47C 27/18; A47C 27/002; A47C 27/122; A47C 27/14; A61G 7/05761; A61G 7/05776; A61G 7/002
See application file for complete search history.

(56) References Cited

U.S. PATENT DOCUMENTS 2,660,735 A * 12/1953 Baum ..... A47C 27/127 5/484
4,631,767 A * 12/1986 Carr ..... A47C 27/082 5/714
5,329,655 A * 7/1994 Garner ..... A61G 7/1026 5/502
5,956,787 A * 9/1999 James ..... A61G 7/001 5/713
6,219,868 B1 * 4/2001 Wang ..... A47C 27/084 5/420
6,370,716 B1 * 4/2002 Wilkinson ..... A61G 5/1043 297/314
6,868,569 B2 * 3/2005 VanSteenburg ..... A47C 27/081 5/709
8,646,459 B2 * 2/2014 Carlson ..... A41D 31/185 128/889
8,719,984 B2 * 5/2014 Miller, Jr. ..... A47C 27/14 5/710
9,241,853 B2 * 1/2016 Carlson ..... A61G 7/057
2001/0023512 A1 * 9/2001 Perez ..... A47C 27/10 5/713
2003/0131419 A1 * 7/2003 VanSteenburg .... A61G 7/05715 5/737
2003/0217414 A1 * 11/2003 Marson ..... B32B 5/32 5/709
2004/0222684 A1 * 11/2004 VanSickle ..... A47C 27/081 297/452.41

(Continued)

*Primary Examiner* — Myles A Throop

(74) *Attorney, Agent, or Firm* — Duncan Galloway Egan Greenwald; Theresa Camoriano; Guillermo Camoriano

(57) ABSTRACT

A patient support arrangement includes features that reduce pressure points and chafing. Chafing is reduced by using a mattress topper including first and second low friction sheets adjacent to each other and secured relative to a cushion, so that when the patient shifts relative to the cushion, the shifting is more likely to be borne between the first and second low friction sheets than between the patient and the mattress topper.

6 Claims, 4 Drawing Sheets

(56) References Cited

U.S. PATENT DOCUMENTS

| | | | | |
|---|---|---|---|---|
| 2005/0102750 | A1* | 5/2005 | Berge | A61G 7/1026 5/81.1 HS |
| 2005/0125905 | A1* | 6/2005 | Wilkinson | A47C 27/10 5/713 |
| 2006/0168736 | A1* | 8/2006 | Meyer | A61G 7/05784 5/727 |
| 2008/0155755 | A1* | 7/2008 | Crousore | A61G 7/015 5/706 |
| 2010/0199434 | A1* | 8/2010 | Keesaer | A61G 1/01 5/628 |
| 2010/0281618 | A1* | 11/2010 | O'Reagan | A61G 7/05769 5/709 |
| 2012/0284926 | A1* | 11/2012 | Tyree | A47C 27/22 5/691 |
| 2013/0212809 | A1* | 8/2013 | Scarleski | A47C 31/105 5/737 |
| 2017/0340133 | A1* | 11/2017 | Scarleski | A47C 31/105 |
| 2019/0307259 | A1* | 10/2019 | Keesaer | A61G 7/05776 |
| 2020/0367664 | A1* | 11/2020 | Scarleski | A47C 31/105 |

* cited by examiner

PATIENT SUPPORT ARRANGEMENT

This application is a continuation-in-part of U.S. Ser. No. 16/378,279, filed Apr. 8, 2019, which claims priority from U.S. Provisional Application Ser. No. 62/654,431 filed on Apr. 8, 2018, both of which are incorporated herein by reference.

BACKGROUND

The present invention relates to the field of mattresses and other patient support arrangements. It is desirable in such arrangements to reduce bed sores, to increase the likelihood of healing of wounds to the skin and body structure, to reduce chafing, to improve comfort, and to provide other health benefits.

SUMMARY

The patient support arrangement supports the patient and conforms to the patient's shape to provide greater comfort as well as skin/soft tissue injury protection and improved wound healing. It includes a hybrid air immersion mattress, which simulates a fluid environment which enhances the patient's circulation, reducing pressure points and aiding in the prevention and management of pressure ulcers, skin flaps, and grafts. The hybrid air immersion mattress includes adjustable air bladders with foam cushions inside the air bladders. The support arrangement also includes a low friction mattress topper, which reduces friction and chafing.

DESCRIPTION

Figure 1:
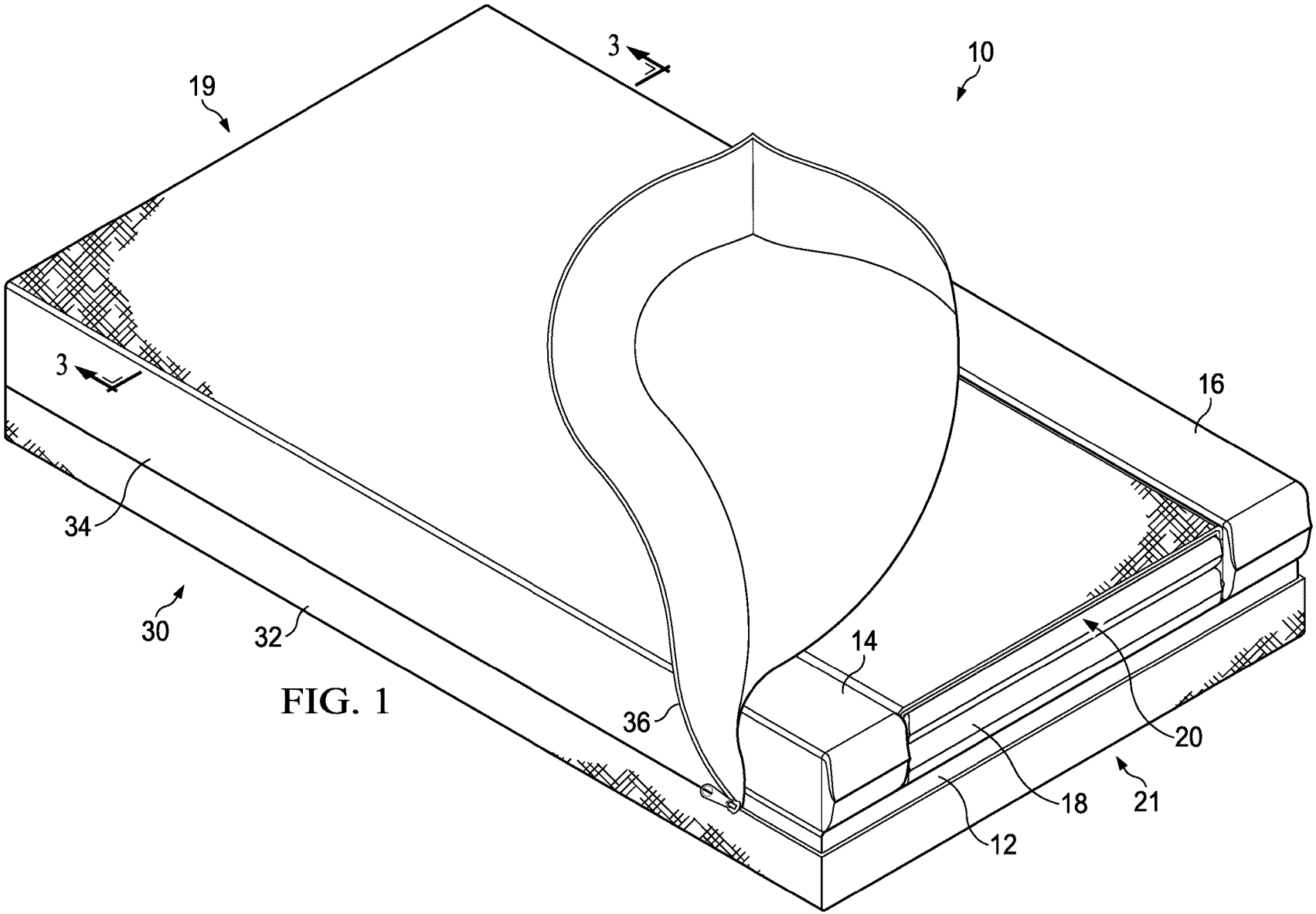
FIG. 1 is a top perspective view of a patient support arrangement, with the cover partially unzipped and pulled back to reveal internal components.
Figure 2:
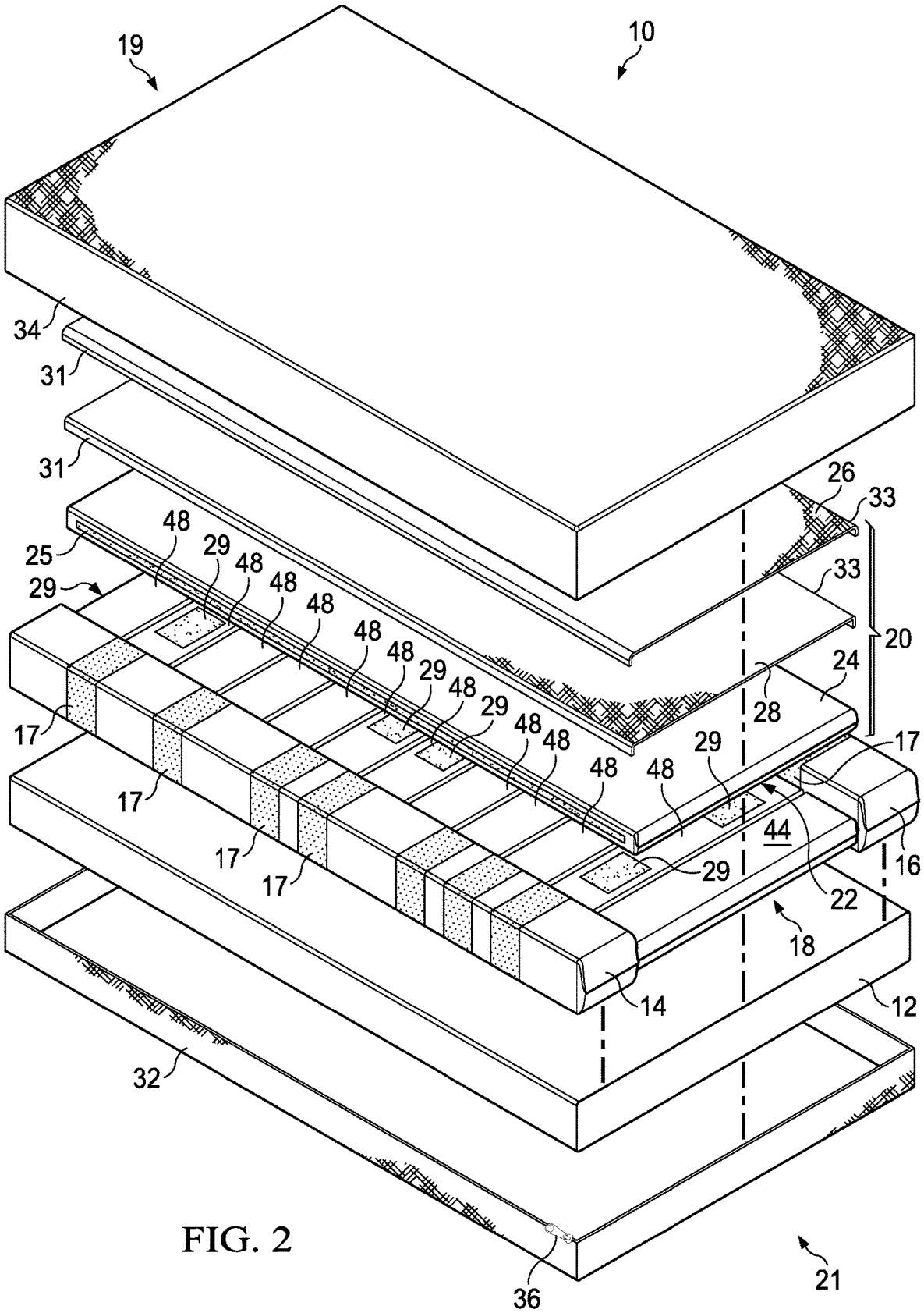
FIG. 2 is an exploded top perspective view of the patient support arrangement of FIG. 1.
Figure 3:
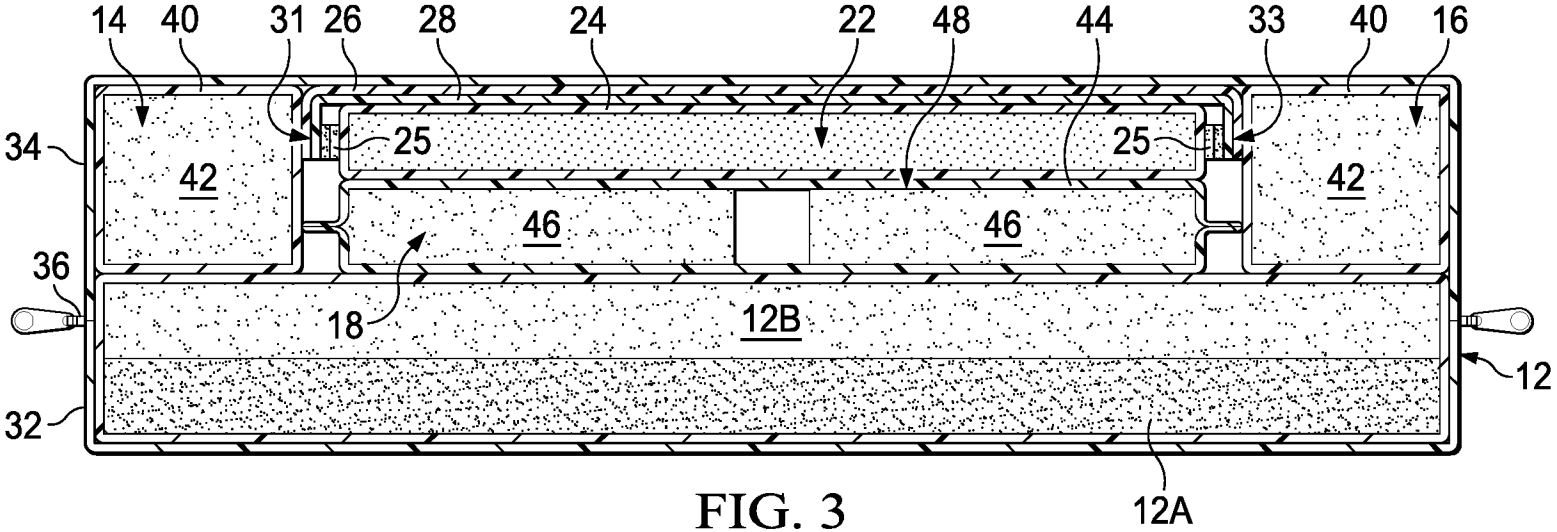
FIG. 3 is a view taken along the section 3-3 of FIG. 1.

FIGS. 1 and 2 show a patient support arrangement 10, which is made up of several parts. A cushion base 12 is made of a foam cushion material covered by a fire sock. The cushion base 12 preferably has a rectangular footprint and a uniform thickness. In this particular embodiment, as shown in FIG. 3, the cushion base 12 is made up of a bottom layer 12A of medium density foam that is two inches thick and a top layer 12B of a high density foam that is two inches thick. Resting on top of the cushion base 12 are left and right bolsters 14, 16 and a hybrid air mattress 18, which are explained in more detail below. The hybrid air mattress 18 extends the full length of the cushion base 12 and covers the central portion of the cushion base, being wide enough to support a person. The left and right bolsters 14, 16 abut the left and right sides of the hybrid air mattress 18 and extend the full length of the cushion base 12. The left and right bolsters 14, 16 are secured to the hybrid air mattress 18 by means of elastic straps 17, which are sewn to the respective left and right edges of the hybrid air mattress 18 and encircle the respective bolster 14, 16. The bolsters 14, 16 are designed to prevent the person lying down on the hybrid air mattress 18 from accidentally rolling off, and they provide firm support when the person is sitting on the edge of the bed. The left and right bolsters 14, 16 have a height that is greater than the height of the hybrid air mattress 18.

Resting on top of the hybrid air mattress 18 and between the bolsters 14, 16 is a mattress topper 20, which includes a cushion 22 covered by a sleeve 24. The cushion 22 preferably is made of a gel foam material, although other known cushion materials could be used. First and second low friction sheets 26, 28 are sewn together along their left and right edges. These sheets 26, 28 are made of a low friction material, so that the friction between the bottom surface of the upper sheet 26 and top surface of the lower sheet 28 is much lower than the friction between any other two adjacent upper and lower surfaces in the arrangement 10 and much lower than between any two normal sheets made of cotton and/or polyester. (In this embodiment, the sheets 26, 28 are made of a material sold under the name "SoarCoat", which is a rip stop nylon coated with silicone, but other sheet materials having similar tensile strength and low friction properties could be used.) The low friction sheets 26, 28 lie on top of the sleeve 24 and are secured to the sleeve 24 along the left and right edges 31, 33 using a strip 25 of hook and loop fastener along the left and right edges of the sleeve 24 and a mating strip of hook and loop fastener along the left and right edges 31, 33 of the bottom surface of the lower sheet 28. This arrangement secures the left and right edges 31, 33 of the low friction sheets to each other and to the cushion 22 while allowing intermediate portions of the low friction sheets to slide easily relative to each other. (Of course, other known securing arrangements could be used instead of sewing the sheets 26, 28 together and using hook and loop fastener to secure the sheets 26, 28 to the cushion 22. The low friction sheets 26, 28 could be sewn to each other and to the cover 24 along the left and right edges 31, 33, or snaps, buttons, or other fasteners could be used.)

In addition, several patches 29 of hook and loop fastener material are adhered to the top surface of the hybrid air mattress 18, with mating patches of hook and loop fastener material adhered to the bottom surface of the sleeve 24 to ensure that the foam cushion 22, sleeve 24, and low friction sheets 26, 28 remain in position above the hybrid air mattress 18.

A cover 30, made up of a vinyl bottom portion 32 and an elastic top portion 34, covers the previously-mentioned elements. The top 34 and bottom 32 of the cover 30 zip together around the perimeter of the patient support arrangement 10 by means of a zipper 36, as shown in FIG. 1.

There is a much higher coefficient of friction between the elastic top 34 and any normal cotton or polyester bedsheets that may be used on top of it than between the two low friction sheets 26, 28. Also, any two normal bedsheets used on top of the elastic top 34 have a much higher coefficient of friction than the low friction sheets 26, 28, so, when a person lying on top of the arrangement 10 shifts around, the upper low friction sheet 26 slides relative to the lower low friction sheet 28 to accommodate the person's shifting, thereby largely allowing the bedsheets to remain stationary relative to the person's skin instead of sliding relative to the person's skin. This greatly reduces abrasion between the person's skin and the bedsheets and/or mattress, thereby protecting the person's skin from damage due to abrasion.

As shown in FIG. 3, each of the left and right bolsters 14, 16 is made of a bladder 40 surrounding an elongated foam cushion 42. The manner in which the bladders are inflated is described in the description of FIG. 4. In this embodiment, each bladder 40 is made of 20 mil poly-film, which is RF (Radio Frequency) welded to form a long cylinder with a diameter of about five inches. The bolsters 14, 16 are inserted through the elastic bands 17 before being inflated.

The hybrid air mattress 18 similarly is made up of a bladder 44 surrounding a plurality of foam cushions 46. The bladder 44 is divided into three chambers, each containing four left-to-right cells 48 (See FIGS. 2 and 4). Each of the first nine left-to-right cells 48 beginning at the head end 19 of the hybrid air mattress 18 contains two spaced-apart foam cushions 46 made of a high density foam material, as shown in FIG. 3. The foam cushions 46 in each of the first nine cells 48 are about three inches thick, and they are spaced from each other by a gap of about three inches in the central portion of the cell 48. In the final three cells 48, at the foot end 21, there is a single, thinner foam cushion 46 of high density foam material extending the full width of the cell 48. In this particular embodiment, the thinner foam cushions 46 at the foot end are two inches thick.

Figure 4:
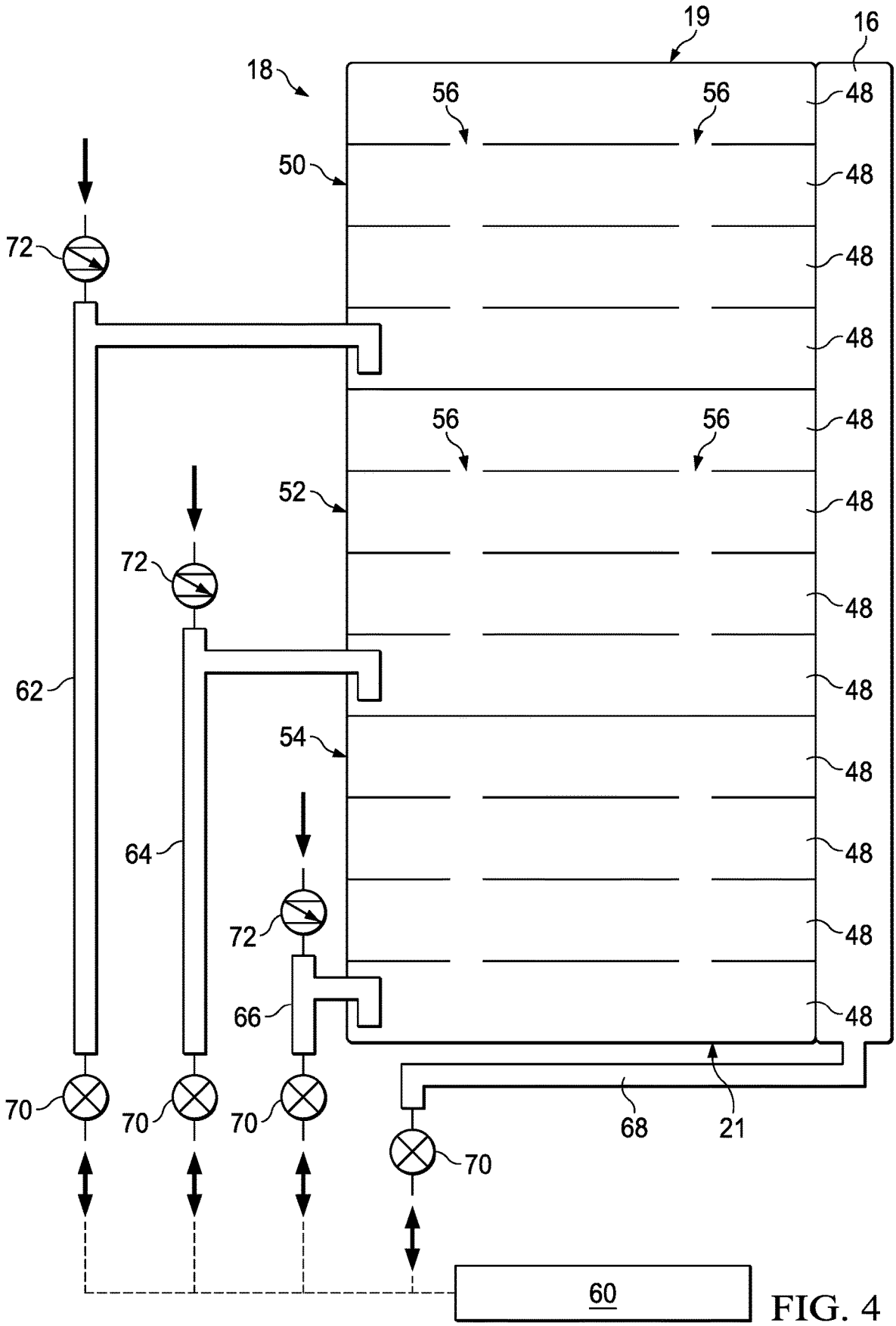
FIG. 4 is a schematic gas flow diagram of the patient support arrangement of FIG. 1.

In this embodiment, the bladder 44 is a single, continuous bladder made from 20 mil poly-film, which is RF (radio-frequency) welded to form twelve, generally rectangular, contiguous, parallel air cells. As shown in FIG. 4, there are three separate air-tight chambers 50, 52, 54, with four cells 48 in each chamber. The RF welding extends completely around the perimeter of each chamber 50, 52, 54 to isolate each chamber, so the chambers are independently inflatable relative to each other. To form the parallel air cells 48 within a chamber, the RF welding is done in parallel lines to form the parallel cells, but small gaps 56 are left in the welded parallel lines to allow air or other gas to flow between the cells 48 within a respective chamber 50, 52, 54. Thus, there is fluid communication between the cells 48 within a respective chamber 50, 52, 54 but not between the chambers.

The first chamber 50, beginning at the head end 19, supports the person's head and shoulders. The second chamber 52 supports the person's torso. The third chamber 54 supports the person's legs and feet.

As shown in FIG. 4, there is a pressurized gas source 60, which may be a bottle of pressurized gas such as air, or may be a hand air-pump, a person blowing air through his mouth, or other pressurized gas source 60. There is an arrangement of tubes and valves that allow the chambers 50, 52, 54 and the bolsters 14, 16 to be inflated by the pressurized gas source 60.

There is a gas line 62, 64, 66 from each respective chamber 50, 52, 54, and there is a gas line 68 to the two bolsters 14, 16. (For clarity, FIG. 4 only shows the right bolster 16, but the left bolster 14 is connected to the same gas line 68 as the right bolster 16, so the two bolsters 14, 16 are at the same pressure.) The gas lines are sealed to their respective chamber or bolster. Each of the gas lines 62, 64, 66, 68 terminates at an inflation valve 70, which is biased in the closed position. When the pressurized gas source 60 is inserted into the inflation valve 70, it opens the inflation valve 70 to allow the pressurized gas to flow into the respective chamber or bolster. The user also may manually open the inflation valve 70 to allow gas to leave the respective chamber or bolster. If the inflation valves 70 are opened, the user may roll up the hybrid air mattress 18, compressing the foam pads 46 as the air escapes out through the valves 70, to store the hybrid air mattress 18 in a small space.

Each of the gas lines 62, 64, 66 leading to one of the respective chambers 50, 52, 54 also has a one-way check valve 72, which allows atmospheric air to enter the respective chamber 50, 52, 54 if the chamber is below atmospheric pressure.

Under normal operating conditions, the three chambers 50, 52, 54 of the hybrid air mattress 18 are inflated by the check valves 72, so they are at atmospheric pressure when at rest (with no person lying on them). The bolsters 14, 16 are inflated by the pressurized gas source 60 to a higher pressure than atmospheric pressure when at rest.

When a person lies down on top of the hybrid air mattress 18, the person's weight slightly compresses the foam cushions 46 inside the cells 48, but the air inside the chambers provides a cushion so the person essentially "floats" on top of the foam cushions 46. Over a period of time, such as a month, with the person lying on the mattress 18, some of the air escapes from the chambers 50, 52, 54. In order to reinflate the chambers 50, 52, 54, the person need only get up out of bed for a few minutes. During that time, the foam cushions spring back to their original shape and pull atmospheric air back into the chambers 50, 52, 54 through the respective check valves 72 to restore the chambers 50, 52, 54 to atmospheric pressure when at rest. Of course, the chambers 50, 52, 54 could be inflated to pressures above atmospheric pressure when at rest using the pressurized gas source 60, with each of the chambers 50, 52, 54 inflated to a different pressure if desired.

It is understood that the mattress topper 20 could be used on top of other types of mattresses other than the hybrid air mattress 18, if desired.

It will be obvious to those skilled in the art that modifications may be made to the embodiments described above without departing from the scope of the invention as claimed.

What is claimed is:

1. A patient support arrangement, comprising:

a foam cushion base;

a hybrid air mattress resting on said foam cushion base, said hybrid air mattress comprising a bladder defining a plurality of cells; a plurality of foam cushions inside said cells; and at least one one-way check valve in fluid communication with said bladder and with atmosphere such that, if the pressure inside said bladder falls below atmospheric pressure, atmospheric air will enter into said bladder through said one-way check valve;

left and right bolsters resting on said foam cushion base and adjacent to said hybrid air mattress, each of said bolsters comprising a bolster bladder, at least one foam cushion in said bolster bladder, and a fill valve in fluid communication with said bolster bladder for filling said bolster bladder from a pressurized gas source;

a mattress topper resting on said hybrid air mattress including a cushion sized to cover said hybrid air mattress, and further comprising first and second low friction sheets lying on top of said cushion, each of said low friction sheets having a left side and a right side, a top surface and a bottom surface, said second low friction sheet lying directly on top of said first low friction sheet, with the bottom surface of said second low friction sheet in direct contact with the top surface of said first low friction sheet, and with the respective left sides of said first and second low friction sheets secured together and secured to said cushion, and the respective right sides of said first and second low friction sheets secured together and secured to said cushion, wherein the coefficient of friction between the bottom surface of said second low friction sheet and the top surface of said first low friction sheet is less than the coefficient of friction between two cotton sheets or two polyester sheets so that, when a bedsheet made of cotton or polyester is placed on top of the mattress topper and a patient lies on top of the bedsheet and shifts around, the second low friction sheet shifts relative to the first low friction sheet to accommodate the patient's shifting, allowing the bedsheet to remain stationary relative to the patient's skin to reduce abrasion; and a cover enclosing said mattress topper, said hybrid air mattress, and said foam cushion base.

2. A patient support arrangement as recited in claim 1, and further comprising a fill valve in fluid communication with said bladder of said hybrid air mattress for filling said hybrid air mattress bladder from a pressurized gas source.

3. A patient support arrangement as recited in claim 2, wherein said first and second low friction sheets are made of silicone coated ripstop nylon or another material having a coefficient of friction at least as low as silicone coated ripstop nylon.

4. A patient support arrangement as recited in claim 1, wherein said cover also covers said left and right bolsters.

5. A patient support arrangement as recited in claim 4, wherein said first and second low friction sheets do not cover said left and right bolsters.

6. A patient support arrangement, comprising:

a base;

a hybrid air mattress lying on a central portion of said base, with left and right portions of said base extending beyond left and right sides of said hybrid air mattress, said hybrid air mattress including a bladder defining a plurality of cells; a plurality of foam cushions inside said cells; and a valve in fluid communication with said bladder for allowing air to enter into said bladder;

left and right bolsters adjacent to the left and right sides of said hybrid air mattress and lying on the respective left and right portions of said base that extend beyond the left and right sides of said hybrid air mattress, said bolsters having a height greater than the height of said hybrid air mattress; each of said bolsters comprising a bolster bladder; and a fill valve in fluid communication with said bolster bladder for filling said bolster bladder from a pressurized gas source;

a mattress topper lying on top of said hybrid air mattress and between said left and right bolsters, said mattress topper including a cushion; first and second low friction sheets lying on top of said cushion, each of said low friction sheets having a left side and a right side, a top surface and a bottom surface, said second low friction sheet lying directly on top of said first low friction sheet, with the bottom surface of said second low friction sheet in direct contact with the top surface of said first low friction sheet, and with the respective left sides of said first and second low friction sheets secured together and secured to said cushion, and the respective right sides of said first and second low friction sheets secured together and secured to said cushion, wherein the coefficient of friction between the bottom surface of said second low friction sheet and the top surface of said first low friction sheet is less than the coefficient of friction between two cotton sheets or two polyester sheets; and a cover extending over said mattress topper and over said left and right bolsters.

* * * * *